United States Patent [19]

Gässler et al.

[11] Patent Number: 4,501,247

[45] Date of Patent: Feb. 26, 1985

[54] ELECTRONICALLY CONTROLLABLE AND REGULATABLE FUEL METERING SYSTEM OF AN INTERNAL COMBUSTION ENGINE

[75] Inventors: Hermann Gässler, Vaihingen/Enz; Eugen Joos, Löchgau; Hans Kubach, Korntal-Münchingen; Wolfgang Maisch, Schwieberdingen; Erich Singer, Besigheim, all of Fed. Rep. of Germany

[73] Assignee: Robert Bosch GmbH, Stuttgart, Fed. Rep. of Germany

[21] Appl. No.: 415,047

[22] Filed: Sep. 7, 1982

[30] Foreign Application Priority Data

Feb. 10, 1982 [DE] Fed. Rep. of Germany ..... 3204548

[51] Int. Cl.[3] ..... F02M 39/00

[52] U.S. Cl. ..... 123/453; 123/454; 123/179 G

[58] Field of Search ..... 123/453, 454, 455, 452, 123/491, 492, 179 L, 179 G

[56] References Cited

U.S. PATENT DOCUMENTS

| | | | |
|---|---|---|---|
| 3,981,288 | 9/1976 | Wessel | 123/454 |
| 4,114,570 | 9/1978 | Marchak et al. | 123/491 |
| 4,132,195 | 1/1979 | Bianchi et al. | 123/454 |
| 4,193,380 | 3/1980 | Marchak et al. | 123/491 |
| 4,240,383 | 12/1980 | Horbelt et al. | 123/491 |
| 4,284,048 | 8/1981 | Schelhas | 123/453 |
| 4,326,488 | 4/1982 | Herth et al. | 123/491 |
| 4,346,681 | 8/1982 | Schleicher et al. | 123/179 L |
| 4,381,751 | 5/1983 | Maisch et al. | 123/454 |
| 4,383,513 | 5/1983 | Gmelin | 123/454 |

FOREIGN PATENT DOCUMENTS

| | | | |
|---|---|---|---|
| 2756345 | 6/1979 | Fed. Rep. of Germany | 123/453 |

*Primary Examiner*—Magdalen Y. C. Moy

*Attorney, Agent, or Firm*—Edwin E. Greigg

[57] ABSTRACT

It is proposed for a fuel metering system that a final control element be triggered with a regulated direct-current signal having clock components dependent on operating characteristics of an internal combustion engine in order to influence a fuel metering means. A further proposal is that the acceleration enrichment be triggered during starting. In this manner the desired starting enrichment is obtained by way of the sum of the post-starting, warm-up and acceleration enrichment. The acceleration enrichment per se begins beyond a predetermined air flow gradient and then has a steady course up to a maximum value. This subject is disclosed in combination with a continuously operating injection system, in which a corresponding overall control signal is prepared in a control unit and delivered to an electro-hydraulic final control element. This final control element, in the specialized example, influences the working pressure of the differential pressure valves associated directly with the continuously functioning injection valves.

6 Claims, 21 Drawing Figures

ELECTRONICALLY CONTROLLABLE AND REGULATABLE FUEL METERING SYSTEM OF AN INTERNAL COMBUSTION ENGINE

BACKGROUND OF THE INVENTION

German Auslegeschrift 24 23 111 discloses a "device for reducing harmful components in the exhaust gas of internal combustion engines". There, a continuously operating fuel injection system is disclosed in which the air throughput in the air intake tube is continuously measured and, together with further operating variables, it is processed to make a control signal for the fuel quantity. The electrical portion of the known apparatus includes the serial disposition of a sawtooth voltage generator, a comparator, and an end stage for an incrementally triggered magnetic valve for controlling the fuel pressure. The input variables of the comparator, in addition to the sawtooth voltage, are individual signals derived from operating variables of the engine and prepared at a summing point. In the more recent German application P 24 37 713.7, an example for one of the signals operating at the summing point is given. It is proposed in this application to provide a hot-starting enrichment for the fuel metering system in such a manner that a monostable multivibrator emits an output pulse whose length is dependent on temperature, and this pulse is then stored in memory in this summing point.

Thus for each correction, the prior art provides a corresponding signal generation. With a view, however, to the most cost-favorable means of mass production of fuel metering systems, the known systems have proven not to be optimal.

OBJECT AND SUMMARY OF THE INVENTION

With the electronically controllable and regulatable fuel metering system and method according to the invention having sensors for operating variables, a control unit and a final control element for influencing the fuel metering, the engineering expenditure for fuel metering systems can be substantially reduced, while the scope of its functioning remains the same.

The invention will be better understood and further objects and advantages thereof will become more apparent from the ensuing detailed description of a preferred embodiment taken in conjunction with the drawings.

DESCRIPTION OF THE PREFERRED EMBODIMENTS

The exemplary embodiment relates to a continuously operating injection system. In terms of the invention, however, the type of fuel metering is not significant, and the invention is equally applicable to controlled carburetor systems and intermittently functioning injection systems.

Figure 1:
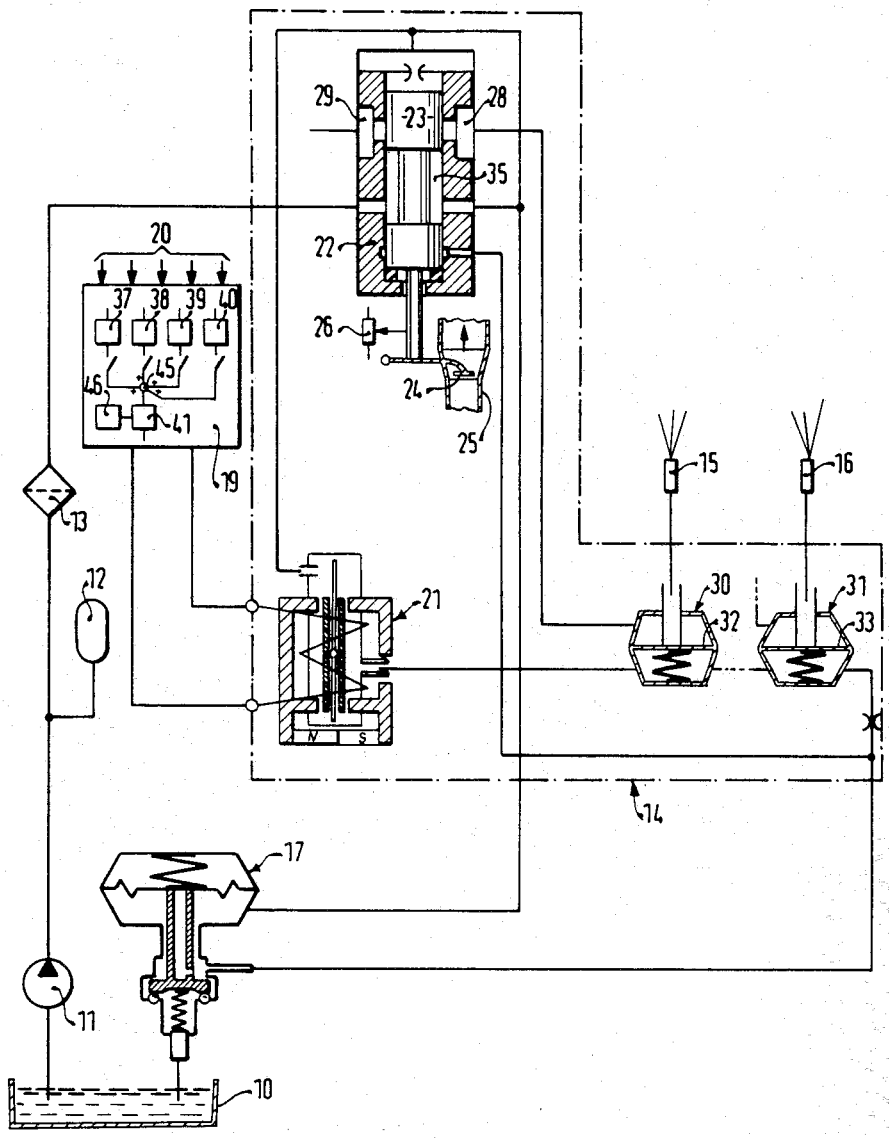
FIG. 1 is a schematic view of a continuously functioning injection system along with its control devices.

FIG. 1 is an overview of a continuously operating injection system having a fuel tank 10, a fuel supply pump 11, a fuel pressure reservoir 12, a filter 13, a fuel quantity divider 14, two injection valves 15 and 16 shown here, and a diaphragm pressure regulator 17, which on the output side communicates with the tank 10 in turn. An electronic control unit is indicated by reference numeral 19. It has various input terminals 20 and on its output side it emits a signal to the electrohydraulic final control element 21. The primary component of the fuel quantity divider is a control sleeve 22 with a control slide 23. The control slide 23 is connected with a baffle plate 24 of a mechanically functioning air flow rate meter 25. In addition, the mechanism of the baffle plate 24 is also coupled with the wiper of a potentiometer 26. The control sleeve 22 has control slits 28, 29 through which fuel flows to differential pressure valves 30 and 31, and is finally directed to the injection valves 15 and 16. These differential pressure valves have spring-loaded diaphragms 32 and 33, and the spring chambers are additionally exposed to the pressure medium flowing through the electrohydraulic final control element 21. More specifically, fuel passes the filter 13 and flows into an intermediate piston chamber 35 of the control slide 23, and from there more or less fuel flows to the metering slits 28 and 29, depending upon the aspirated quantity of air, and further via the differential pressure valves 30 and 31 to the injection valves 15 and 16. Pressure medium furthermore flows onto the end located opposite the baffle mechanism of the control slide 23 and through the electrohydraulic final control element 21. By way of the diaphragm pressure regulator 17, finally, the leakage fluid of the quantity divider as well as the pressure medium of the differential pressure valves 30 and 31 flow back into the tank 10.

The fundamental arrangement of the continuously functioning injection system shown in FIG. 1 is known per se. Also known, for instance from the prior publications discussed at the outset above, is exerting electrical influence on the individual variables. For instance, a series of blocks 37–41 is shown in block 19, these being post-starting enrichment 37, warm-up enrichment 38, acceleration enrichment 39, an additional correction circuit 40 and a current regulator 41. All the correction circuits are connected with the current regulator 41 via switches not otherwise shown and a summing point 45. An apparatus for shutting off the supply of gasoline 46 during overrunning is associated with the current regulator 41. The subjects of the invention are the functioning and ciruitry of the electronic control unit 19 of the subject of FIG. 1 together with its method of operation.

Figure 2A:
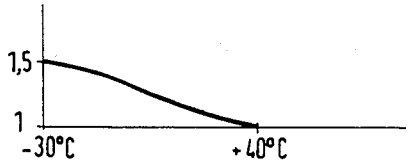
FIGS. 2*a*, 2*b* and 2*c* show various characteristic curves for enrichment factors.
Figure 2B:
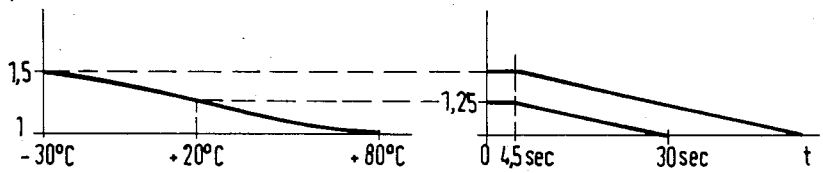
Figure 2C:
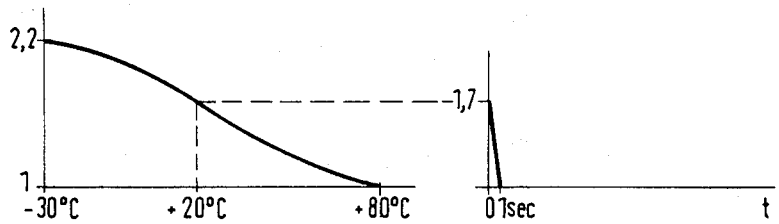

In FIG. 2, various characteristic curves for the enrichment of the mixture are shown. FIG. 2*a* illustrates conditions during the warm-up phase. At −30° C., the enrichment factor is 1.5, and in the illustrated embodiment it decreases in a nonlinear function to 0, this point being attained at the temperature of +40° C. The post-starting enrichment shown in FIG. 2*b* is dependent upon both temperature and time. The enrichment factor has a slightly curved function extending from 1.5 to 0 between −30° C. and +80° C. After the end of the starting phase, that is after the starting switch has become inactive, the enrichment factor at first remains constant, for approximately 4.5 seconds. A downward regulation of enrichment then begins which is linear in terms of time. The downward regulation of breakaway time is dependent on the engine temperature. The enrichment for acceleration shown in FIG. 2*c* begins at −30° C. at an enrichment factor of 2.2 and ends at +80° C. At +20° C., this enrichment has a factor of 1.7 and an enrichment duration of approximately 1 second.

Figure 3A:
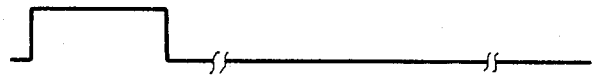
FIGS. 3*a* and 3*b* are a functional illustration of conditions in the cases of starting and post-starting.
Figure 3B:
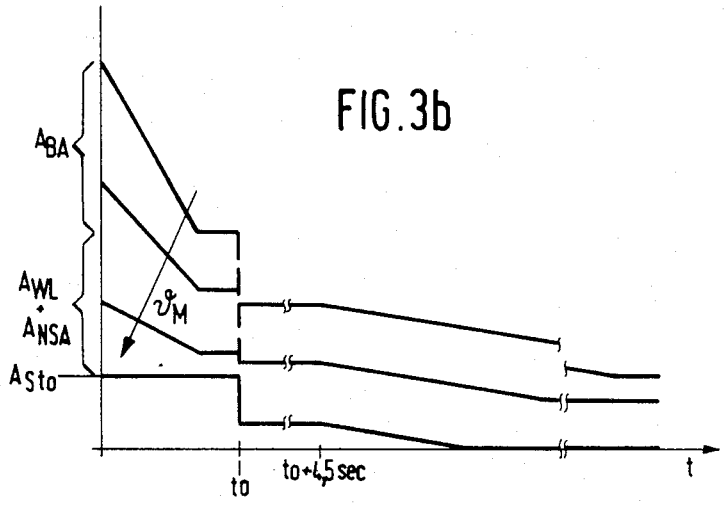

One field of application of the invention relates to conditions during starting. In this operational state, it is provided that the starting enrichment is effected not via separate control circuit but rather on the basis of the sum of the initial signals for warm-up enrichment, post-starting enrichment, and acceleration enrichment as well as a basic value not dependent on engine temperature. These conditions are illustrated in FIG. 3. While FIG. 3*a* shows the starter signal, FIG. 3*b* illustrates the total current for the electrohydraulic final control element 21, which is a composite of the individual currents for the warm-up and post-starting enrichment as well as the current for acceleration enrichment and a basic current. It will be seen from the diagram that at the beginning of the starting process there is a steep increase in current up to the maximum value predetermined by the acceleration enrichment, with a subsequent reduction of this maximum value in accordance with conditions during acceleration enrichment as a linear function of time. The acceleration portion terminates approximately 1.0 second after the onset of starting in the illustrated example. The warm-up enrichment is independent of the actuation of the starter, and this is also true of the initial value of the post-starting enrichment. After approximately 4.5 seconds, the time-linear downward regulation of post-starting enrichment begins. The overall downward regulation time of the post-starting component is in the range from approximately 6–90 seconds ater the end of starting, depending upon the temperature of the engine. The warm-up enrichment component is oriented exclusively to the engine temperature attained, as illustrated in FIG. 2*a*.

The individual circuits shown in FIGS. 4–9 serve to realize the curve course illustrated in FIG. 3*b*.

Figure 4:
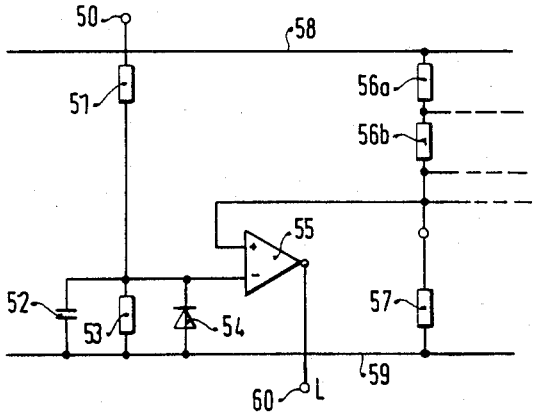
FIG. 4 is a circuit layout for emitting a starting signal.

FIG. 4 shows a starting signal triggering circuit layout. This circuit comprises an input terminal 50, which is followed, in order to supress disturbances, by a low-pass filter having a resistor 51 and a capacitor 52. The voltage signal of terminal 50 is divided downward by the resistors 51 and 53. The capacitor 52 and a diode 54 represent protective measures. The input signal reaches the negative input of an operational amplifier 55. The positive input of this element 55 receives a voltage signal from a voltage divider, having at least two resistors 56 and 57, located between a positive line 58 and a negative line 59. At the output side the operational amplifier 55 is coupled with a terminal 60, from whence the post-starting and acceleration enrichment as well as a possible basic current for starting enrichment which is not dependent on temperature are effected.

Figure 5A:
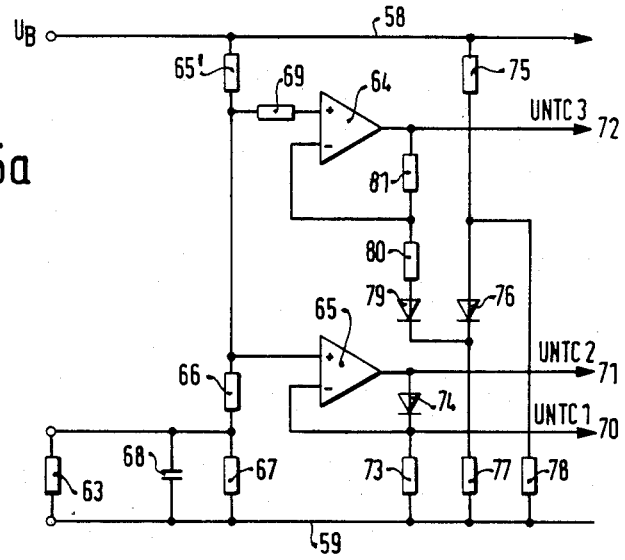
FIGS. 5*a*, 5*b* and 5*c* disclose a circuit layout for preparing a temperature signal.

For the enrichment stages listed first, temperature-dependent voltage signals are necessary. They are formed in a circuit layout as shown in FIG. 5*a*, on the basis of the voltage drop across an NTC resistor.

Figure 5B:
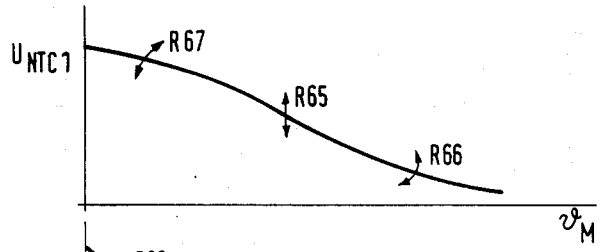
Figure 5C:
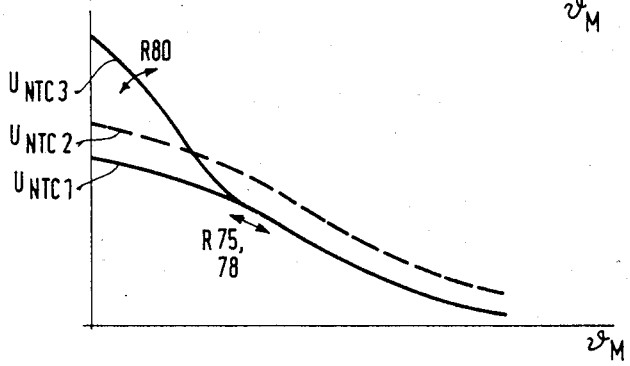

The primary features of the circuitry shown in FIG. 5 are an NTC resistor 63 as well as two operational amplifiers 64 and 65. A two-stage voltage divider having the three resistors 65', 66 and 67 is located between the voltage supply lines 58 and 59. A capacitor 68 as well as the NTC resistor 63 are disposed parallel to the resistor 67. While the positive input of the operational amplifier 65 is connected directly with the connecting point of the two resistors 65' and 66, a resistor 69 leads to this coupling point from the corresponding input of the operational amplifier 64. This resistor 69 serves the purpose of input current compensation for the amplifier 64. Three output terminals of the circuit layout of FIG. 5 are indicated by reference numerals 70, 71 and 72. The output 70 is connected directly with the negative input of the amplifier 65 and furthermore via a resistor 73 with the ground line 59. On the output side the amplifier 65 is connected directly with the terminal 71. A connection additionally exists with terminal 70 via a diode 74. The output 72 in turn corresponds directly to the output of the operational amplifier 64. A series circuit comprising a resistor 75, a diode 76 and a resistor 77 is furthermore located between the operational voltage lines. A resistor 78 leads from the connecting point between the resistor 75 and the diode 76 to the ground line 59. On the other side, the connecting point between the diode 76 and the resistor 77 is connected via a series circuit of a diode 79, a resistor 80 and a resistor 81 with the output of the operational amplifier 64, the resistor 81 additionally serving as a negative-feedback resistor.

The output voltages UNTC1 and UNTC3 are applied to the output terminals 70, 71 and 72, the first of which serves the purpose of warm-up and post-starting enrichment, the second for acceleration enrichment and the third likewise for the warm-up and post-starting enrichment.

The signal courses illustrated in FIGS. 5*b* and *c* are so-called component-function diagrams. They characterize the dependency of the various curve courses on the individual components indicated in FIGS. 5*b* and *c*. It will be seen that there is a variously nonlinear course of the curves with signal values which become lower as the temperature becomes higher. The resistors 75, 78 influence the point at which UNTC 3 changes course. FIG. 6 shows a circuit layout and a component-function illustration for warm-up enrichment. From the terminals 70 and 72, one resistor 85 and 86 each leads to the positive input of an operational amplifier 87, which is additionally coupled via a resistor 88 and 89 with each of the two supply lines 58 and 59. On the output side the operational amplifier 87 is connected via a series circuit of a diode 90 and a resistor 91 with the summing point 45 shown in the control unit 19 of FIG. 1. The negative-feedback branch of the operational amplifier 87 includes the diode 90.

Figure 6A:
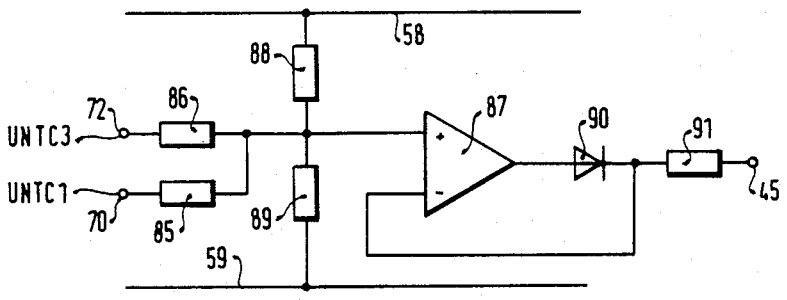
FIGS. 6*a* and 6*b* show the electrical circuit portion relating to warm-up enrichment.
Figure 6B:
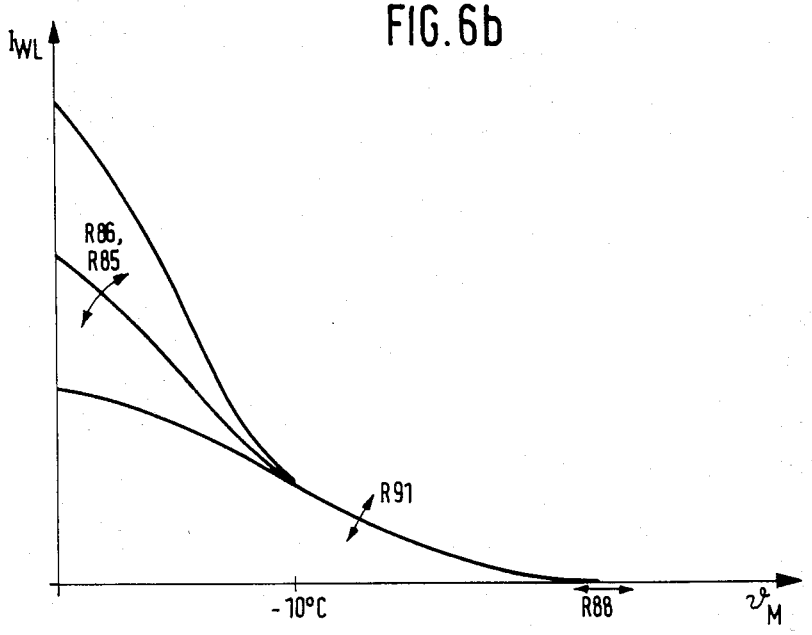

With the circuitry shown in FIG. 6*a*, the curve course shown in FIG. 6*b* can be realized. In this diagram of FIG. 6*b*, as was the case with FIGS. 5*b* and *c*, the influences of the individual components which determine the steepness of the curve are indicated. Specifically, the downward-regulation threshold is fixed by the resistor ratio 85/86 to 88 for downward regulation thresholds greater than approximately 20° C. For downward regulation thresholds at a lower level, the resistor 89 is used instead of the resistor 88. The curve course itself can be varied at given resistance values of the resistors 88 and 89 for lower temperatures by varying the resistors 85 and 86, by way of which the two voltages UNTC1 and UNTC3 can then be adjusted in any arbitrary manner. In the circuitry shown in FIG. 6*a*, the course of the warm-up enrichment above the point of changing course tends toward UNTC1 at a temperature of approximately −10° C., while for temperature values below this a signal course can be selected which is between a minimum and a maximum steepening of the curve. Given a temperature characteristic fixed by the resistors 86–89, the warm-up enrichment factor can be fixed by means of resistor 91.

Figure 7A:
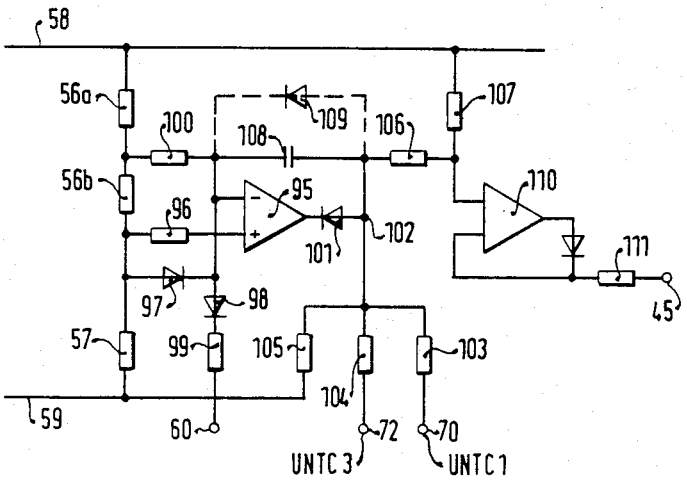
FIGS. 7*a* and 7*b* show the electrical circuit portion relating to post-starting enrichment.
Figure 7B:
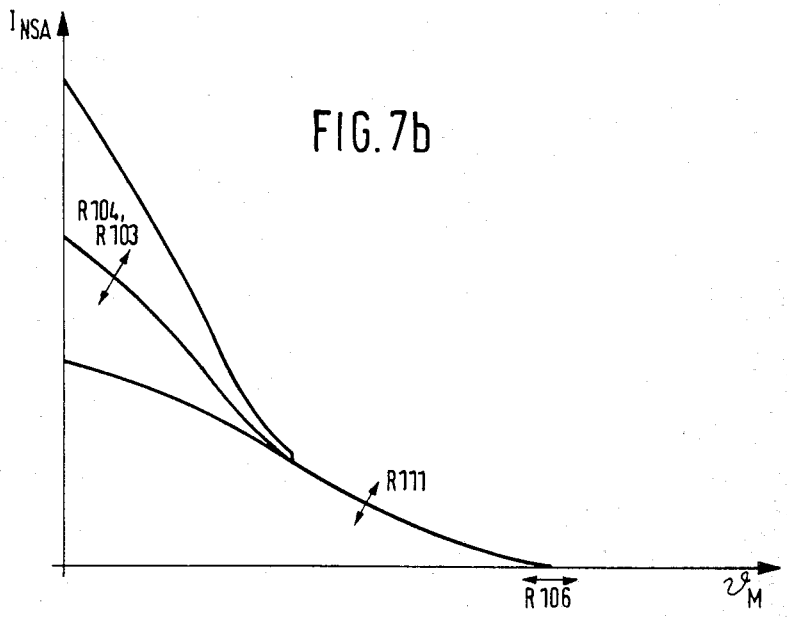

FIG. 7 shows a circuit layout and component-function illustrations for post-starting enrichment. The circuitry of FIG. 7*a* includes an operational amplifier 95, the positive of which is connected via resistor 96 with the voltage divider apparatus known from FIG. 4 and including resistors 56*a, b* and 57. From the same voltage divider connection point, a diode 97 leads to the negative input of the operational amplifier 95, and this negative input is additionally connected via a diode 98 and a resistor 99 with the connection point 60 of the subject of FIG. 4, and is furthermore connected via a resistor 100 with the connecting point of the two resistors 56*a* and *b*. On the output side the operational amplifier 95 is followed by a diode 101, which is carried to a branching point 102. The branching point is connected via a resistor 103 with the connection terminal 70, via a resistor 104 with the terminal 72, via resistor 105 with the ground line 59, and via a series circuit of the two resistors 106 and 107 with the negative line 58. Further located between this connection point 102 and the negative input of the operational amplifier 95 are a capacitor 108 and a diode 109 switched parallel to this capacitor. At the connecting point of the two resistors 106 and 107 there is a control voltage UNSA, which is subsequently inverted in a voltage/current converter by means of an inversely coupled operational amplifier 110 into a control current which then flows across a resistor 111 to the summing point 45 known fro FIG. 1. The mode of operation of the circuitry of FIG. 1, given an awareness of the signal course in FIG. 7*b*, does not present any difficulties. The individual curve portions can be fixed by way of the selection of the individual resistance values, in order to obtain downward regulation curves of varying steepness and to obtain a value which is variable in terms of the end point. What is important is that FIG. 7*b* illustrates the initial values for the post-starting enrichment.

Figure 8:
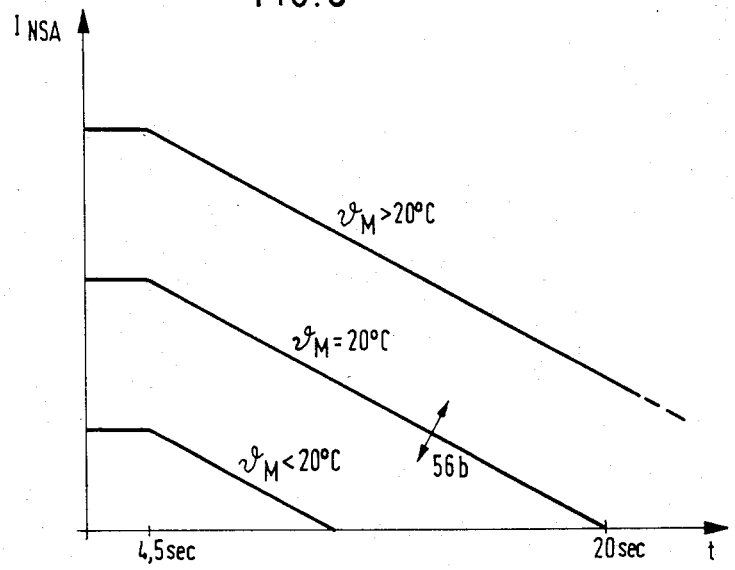
FIG. 8 provides downward regulation curves for this post-starting enrichment.

Because of its circuitry, the operational amplifier 95 is an integrator having a signal course over time as illustrated in FIG. 8. Three values are indicated in the diagram of FIG. 8, that is, downward regulation curves for temperature values less than 20° C., equal to 20° C. and greater than 20° C.; the inclination of the particular downward regulation curve is measured at the value of the resistor 56*b*. The circuitry of the operational amplifier 95 of FIG. 7 is designed such that the downward regulation begins approximately 4.5 seconds after the onset of starting and ends, for instance at a temperature of 20° C., after a total of 20 seconds' duration.

FIG. 9 relates to a circuit layout and signal courses for the acceleration enrichment. The basic concept of the acceleration enrichment is to ascertain the movement of the baffle plate of the air flow rate meter and to fix the magnitude of the enrichment in accordance with this movement. To this end, the potentiometer 26 seen in FIG. 1 in combination with the baffle plate of the air flow rate meter is here connected with a differentiating member. A timed downward regulation considered to be efficacious now takes place for a pre-specified acceleration enrichment, and the intervention into the summing point is effected via a clocked temperature signal. More specifically, the design is as follows: The potentiometer 26 is followed by a low-pass filter having a resistor 115 and a capacitor 116. This is coupled with the negative input of an operational amplifier 119 via a differentiating member comprising a series circuit of a capacitor 117 and a resistor 118. A two-stage voltage divider between the two battery voltage lines 58 and 59 has the resistors 120, 121 and 122. While the connecting point of the two resistors 121 and 122 is carried via a resistor 123 to the negative input of the amplifier 119, the other connecting point is connected with the positive input, from whence one conductor is connected via a capacitor 125 to ground and which is coupled via a series circuit of a resistor 126 and a diode 127 with a connection terminal 128, at which a signal pertaining to a closed or open throttle valve is present (idling contact). In the inversely-connected branch of the operational amplifier 119, there is a series circuit of a diode 130 and a resistor 131. From its output, one diode 132 leads to a coupling point 133, which is connected via a capacitor 134 with the connecting terminal 60 of the subject of FIG. 4. This coupling point 133 also receives a positive voltage signal from the line 58 via a resistor 135, and a resistor 136 also leads to the negative input of a subsequent amplifier 138, which is designed as a voltage/duty factor converter. Its output is connected via a resistor 140 with the positive line 58 and via a series circuit of two resistors 141 and 142 with the negative line 59. The coupling point of the two last-named resistors 141 and 142 is carried to the base of a transistor 143 which is connected at the emitter side to the negative line 59. Its collector receives supply voltage via a resistor 144 from the positive line 58, and via a resistor 145 likewise supplies the negative input of the amplifier 138. A voltage divider having the two resistors 147 and 148 between the battery voltage lines 58 and 59 supplies the positive input of the amplifier 138 via a resistor 149 with a trigger voltage. This input is furthermore connected via a resistor 150 with the collector of the transistor 153 and via a capacitor 151 with the ground line 59. From the output of the amplifier 138, finally, one diode 153 leads to a connecting point of a resistor 154 and a diode 155, the resistor 154 being connected to the connection terminal 71 of the subject of FIG. 5 and the diode 155 leading to a voltage divider comprising two resistors 156 and 157 located between the summing point 45 and the negative line 59.

Figure 9A:
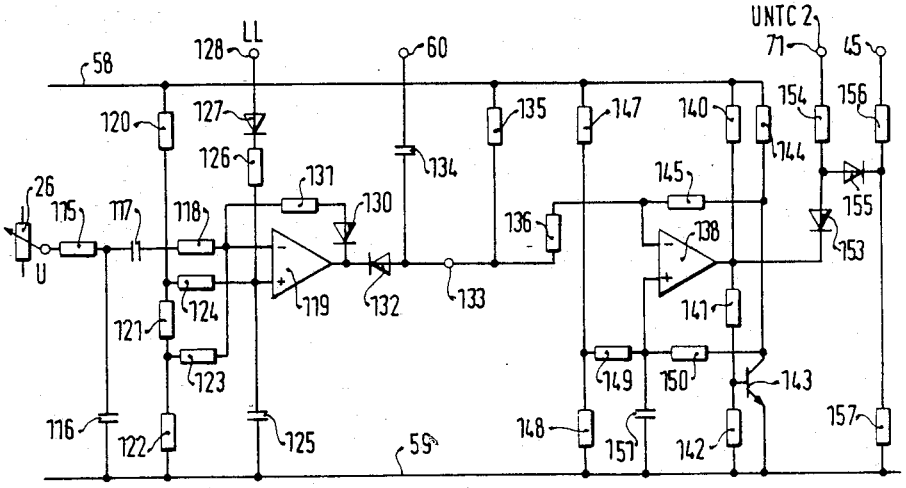
FIG. 9*a* illustrates a circuit layout for accelerating enrichment, while the graphs of FIGS. 9*b* through 9*f* show conditions during acceleration phases.
Figure 9B:
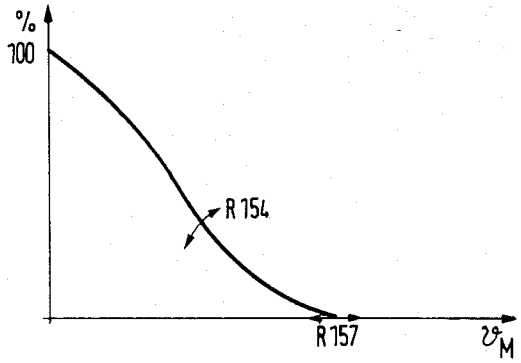
Figure 9C:
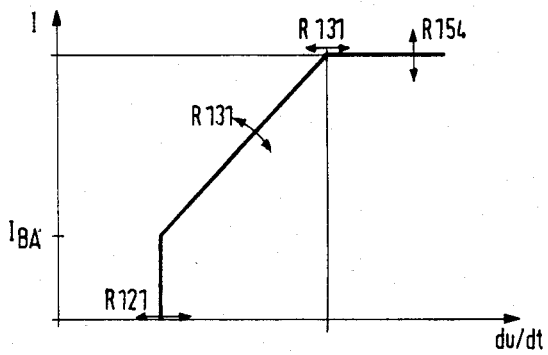
Figure 9D:
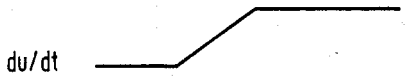

The subject of FIG. 9*a* will be efficaciously explained with the aid of the following signal illustrations. FIG. 9*b* in a coponent-function illustration shows the clocked output current IBA at summing point 45 in accordance with the engine temperature. It can be seen that there is a greater enrichment as the temperature becomes lower, and the onset point of enrichment and the course of the curve can be influenced via the resistors 157 and 154. The dependency of the enrichment on the speed of the change in position of the air flow rate meter baffle plate which is desired for a specialized case is shown in FIG. 9*c*. The acceleration enrichment according to FIG. 9*c* begins only above a predetermined speed in the change of the baffle plate position; it increases abruptly to a predetermined minimum value and from there takes a linear course up to a maximum value and then remains constant. The individual enrichment values and functional courses can be learned by way of the resistances shown in FIG. 9*c*.

Figure 9E:
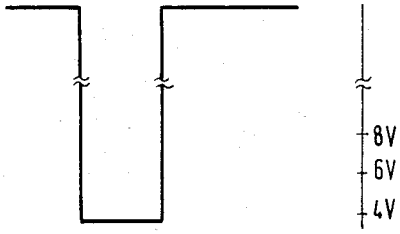
Figure 9F:
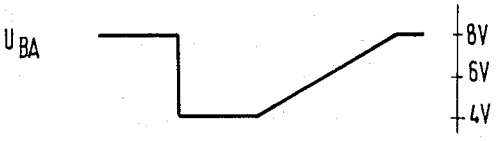

If the voltage U at the wiper of the potentiometer 26 increases linearly as shown in FIG. 9*b*, then the voltage gradient produces a signal at the output of the operational amplifier 119 as shown in FIG. 9*e*. The maximum value of this signal is at first fixed by the diode 132 and the capacitor 134. With a lessening of the voltage increase, that is flatter voltage gradients, a timed downward regulation as shown in FIG. 9*f* becomes effective because following an again higher output value of the operational amplifier 119 UBA, the discharge via the resistors 135, 136 and 145 begins. A clocked discharge is effected via the two last resistors 136 and 145, in order to obtain the desired linear downward regulation. The clock frequency is selected to be so high that the individual pulse intervals do not make themselves felt as interference in the electrohydraulic final control element 21.

FIG. 9*a* also clearly illustrates the separate triggering of the acceleration enrichment via the connection terminal 60, at which a starter signal as shown in FIG. 4, comes into effect. Upon each starting event, the acceleration enrichment is thus triggered. For this reason, a starting enrichment with an additional timing element is no longer required. The exemplary embodiment shows one realization of the invention with discrete components. Once the concept underlying the invention is known, one skilled in the art will also find no difficulty in attaining a computerized realization.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for electronically controlling and regulating fuel in an internal combustion engine, particularly in a continuously functioning injection system, having sensors for sensing operating variables, and a fuel metering means comprising the steps of, generating signals responsive to post-starting, warm-up and acceleration enrichment, delivering said signals to an electrical summing point, combining said signals together with a base signal for generating a regulated direct current having clock components dependent on said operating variables, and influencing said fuel metering means with said regulated current signal.

2. An electronically controllable and regulatable fuel metering system including fuel metering means in an internal combustion engine, in particular, a continuously functioning injection system, having sensors for sensing operating variables, a control unit, a final control means for influencing the fuel metering means, said control unit comprising means for providing a regulated direct current signal combining clock signal components for controlling said final control means, said clock signal components being dependent on said operating variables, and an electrical summing point preceding said final control means to which said signals relating to post-starting, warm-up and acceleration enrichment are delivered.

3. An electronically controllable and regulatable fuel metering system including fuel metering means in an internal combustion engine, in particular, a continuously functioning injection system, having sensors for sensing operating variables, a control unit, a final control means comprising an electrohydraulic element serving as a pressure regulator for influencing the fuel metering means, said control unit comprising means for providing a regulated direct current signal combining clock signal components for controlling said final control means, said clock signal components being dependent on said operating variables, and an electrical summing point preceding said final control means to which said signals relating to post-starting, warm-up and acceleration enrichment are delivered.

4. An electronically controllable and regulatable fuel metering system including fuel metering means in an internal combustion engine, in particular, a continuously functioning injection system, having sensors for sensing operating variables, a control unit, a final control means for influencing the fuel metering means, said control unit comprising means for providing a regulated direct current signal combining clock signal components for controlling said final control means, said clock signal components being dependent on said operating variables, an electrical summing point preceding said final control means to which said signals relating to post-starting, warm-up and acceleration enrichment are delivered, and wherein the initial value of the post-starting enrichment signal is dependent on temperature, said post-starting circuit means having means for regulating downward said signal in accordance with time.

5. An electronically controllable and regulatable fuel metering system including fuel metering means in an internal combustion engine, in particular, a continuously functioning injection system, having sensors for sensing operating variables, a control unit, a final control means for influencing the fuel metering means, said control unit comprising means for providing a regulated direct current signal combining clock signal components for controlling said final control means, said clock signal components being dependent on said operating variables, an electrical summing point preceding said final control means to which said signals relating to post-starting, warm-up and acceleration enrichment are delivered, and wherein at least one of said post-starting and warm-up enrichment circuit means includes means for processing two differently prepared temperature voltages.

6. An electronically controllable and regulatable fuel metering system including fuel metering means in an internal combustion engine, in particular, a continuously functioning injection system, having sensors for sensing operating variables, a control unit, a final control means for influencing the fuel metering means, said control unit comprising means for providing a regulated direct current signal combining clock signal components for controlling said final control means, said clock signal components being dependent on said operating variables, an electrical summing point preceding said final control means to which said signals relating to post-starting, warm-up and acceleration enrichment are delivered, and wherein said acceleration circuits means includes means for delivering said acceleration enrichment signal in the form of a clocked signal to said summing point.

* * * * *